United States Patent [19]

Knapp et al.

[11] Patent Number: 4,520,092

[45] Date of Patent: May 28, 1985

[54] PROCESS FOR PREVENTING DEPOSITION OF TONER PARTICLES IN AN IMAGING APPARATUS

[75] Inventors: John F. Knapp, Fairport; Robert J. Gruber, Pittsford, both of N.Y.

[73] Assignee: Xerox Corporation, Stamford, Conn.

[21] Appl. No.: 566,754

[22] Filed: Dec. 27, 1983

Related U.S. Application Data

[63] Continuation-in-part of Ser. No. 219,674, Dec. 24, 1980, abandoned.

[51] Int. Cl.[3] ..... G03G 13/09

[52] U.S. Cl. ..... 430/120; 430/122

[58] Field of Search ..... 430/120, 122

[56] References Cited

U.S. PATENT DOCUMENTS

| | | | |
|---|---|---|---|
| 3,239,465 | 3/1966 | Rheinfrank | 252/62.1 |
| 3,590,000 | 6/1971 | Palermiti et al. | 252/62.1 |
| 3,872,826 | 3/1975 | Hanson | 118/696 |
| 4,082,681 | 4/1978 | Takayama et al. | 252/62.1 |
| 4,288,519 | 9/1981 | Diamond et al. | 430/137 |

*Primary Examiner*—John D. Welsh

*Attorney, Agent, or Firm*—E. O. Palazzo

[57] ABSTRACT

A process for obtaining smudge resistant images and for preventing the deposition of unwanted toner particles in an imaging apparatus which comprises (a) providing a xerographic imaging apparatus, (b) adding an improved two component contamination free developer composition to said apparatus, which composition consists essentially of from about 50 percent to about 80 percent by weight of a resin comprised of the polymeric esterification product of a dicarboxylic acid and a diol comprising a diphenol of the following formula

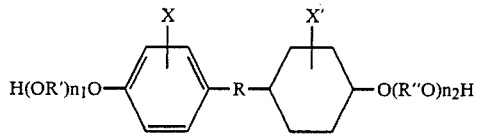

wherein R is selected from substituted and unsubstituted alkylene radicals having from about 2 to about 12 carbon atoms, alkylidene radicals having from 1 to 12 carbon atoms and cycloalkylidene radicals having from 3 to 12 carbon atoms; R' and R" are selected from substituted and unsubstituted alkylene radicals having from 2 to 12 carbon atoms, alkylene arylene radicals having from 8 to 12 carbon atoms and arylene radicals; X and X'; are selected from hydrogen or any alkyl radical having from 1 to 4 carbon atoms; and each n is a number of from 0 (zero) to 4, about 20 percent to about 50 percent by weight of magnetite and a carrier material consisting of a steel core coated with a polymethyl methacrylate resin or a polyvinylidene fluoride resin, (c) forming electrostatic latent images in the imaging apparatus, and (d) developing the images formed.

7 Claims, No Drawings

PROCESS FOR PREVENTING DEPOSITION OF TONER PARTICLES IN AN IMAGING APPARATUS

BACKGROUND OF THE INVENTION

This application is a continuation-in-part application of U.S. Ser. No. 219,674, filed On Dec. 24, 1980 on Contamination Free Toner and Process, abandoned.

This invention is generally directed to a process for preventing the contamination of components contained in an imaging apparatus, and more specifically the present invention is directed to an improved process for preventing the deposition of toner particles on components contained in a xerographic imaging apparatus. In one embodiment the present invention is directed to an improved process for preventing contamination of components, such as corotrons, present in a xerographic imaging apparatus wherein there is selected for the process a two-component developer composition containing a specific polyester resinous material. Also, in another embodiment of the present invention there is provided a process for obtaining smudge resistant images, that is images possessing adequate fixing, wherein there is selected a two-component developer composition containing a specific polyester resinous material and a magnetite composition.

The selection of developer compositions containing toner and carrier particles, and single component developer compositions are well known. There is thus disclosed in U.S. Pat. No. 3,239,465 a xerographic developer containing finely divided toner particles uniformly, electrostatically coated on a carrier surface which toner particles consist essentially of an organic resinous binder and at least one ferromagnetic material. Examples of organic resins illustrated in this patent include phenol-formaldehyde resins, rosin-modified phenol-formaldehyde and maleic glyceride resins, polystyrene and butadiene-styrene copolymers, polystyrene resins, and other similar resins, reference the disclosure in column 9 beginning at around line 55. The magnetic component is a material which will respond to a low or high frequency of magnetic field, and includes substances such as magnetic iron and its alloys according to the disclosure of this patent. Specific magnetic substances selected include nickel iron alloys, nickel-cobalt-iron alloys, and magnetic oxides such as magnetite, reference the disclosure in column 10, beginning at line 1. One problem associated with the developer compositions disclosed in this patent is that the resulting developed images possess inadequate fixing characteristics causing undesirable smudging of the images.

Also disclosed in U.S. Pat. No. 3,345,294 is a developer composition comprised of specific ingredients including, for example a resin, a major portion of which is a polyamide substance having a sharp melting point within the range of from about 70 degrees centigrade to about 165 degrees centigrade. As disclosed in column 4, beginning at line 34 of this patent, a small amount of finely divided magnetic substance is added to the developer particles in order to reduce the tendency of the developer powder or toner to adhere to the background of the resulting print. Examples of magnetic substances disclosed in this patent include magnetic iron oxides, ferrosoferric oxide powders, a magnetic metal substance, or an alloy. The magnetic material is generally present in an amount of between 5 percent and 25 percent by weight, reference the disclosure in column 4, beginning at line 38.

Additionally, there is disclosed in U.S. Pat. No. 4,082,681, a magnetic developer for xerographic imaging systems containing a magnetic material dispersed in a resinous binder, with finely divided solid conducting substances such as conductive carbon black particles. This patent is representative of several patents disclosing the use of magnetic materials in developer compositions. Moreover, there is disclosed in U.S. Pat. No. 4,288,519 a dual purpose single component conductive magnetically attractive toner containing a mixture of a thermoplastic resin, finely divided magnetic pigments, and conductive pigments, wherein as a resinous substance there can be selected a linear polyester consisting of the condensation product of an aromatic diol with an unsaturated aliphatic dibasic acid having a softening point of from about 95 degrees centigrade to about 150 degrees centigrade, and an ethylenevinylacetate copolymer. Furthermore, the use of polyester resins as toner components are disclosed generally in U.S. Pat. No. 3,590,000.

While the prior art toner compositions are sufficient for their intended uses, many of these materials have a tendency to undesirably contaminate the components contained in the xerographic imaging apparatus. With these toner compositions, the toner particles tend to separate from the carrier particles prior to, for example contacting the latent image contained on the photoconductive member. The separated toner particles are then free to deposit on machine components, for example, and thus contaminate the machine environment, thereby resulting in developed images of low resolution or no developed images whatsoever, and causing possible environmental problems. Further, in view of the deposition of the toner particles on the machine components, it is necessary over a period of time to replace or clean such components which adds to the cost of machine maintenance. For example, when unused toner particles deposit on the optical systems present in electrophotographic machine environments, a latent image corresponding to the original to be copied will not be fully formed, if formed at all, on the photoreceptor surface thereby resulting in a final fused image of very low quality which in some instances may be unreadable depending on the amount of toner particles that have deposited on the optical parts thereof. Additionally, in some instances, the resulting images are not completely fixed to the final substrate causing undesirable smudging. Contamination and smudging is eliminated with the process of the present invention primarily since the toner particles are prevented from separating from the carrier particles prior to, for example, contacting the latent image, which toner particles separate therefrom as a result of collisions between the toner particles and carrier particles contained in the developer composition with the components of electrophotographic imaging apparatus.

Accordingly, there is a need for a process that prevents contamination of machine components with toner particles. Additionally, there continues to be a need for processes which substantially eliminate dust and allow the toner particles to remain attached to the carrier particles subsequent to collisions with components in the electrophotographic apparatus. Moreover, there continues to be a need for processes for preventing toner particles from depositing on components contained in the electrostatographic imaging apparatus, these components including, for example, the developer housing apparatus, charging devices, such as corona wires, optical parts, lamps, and the like, which deposition adversely effects the operation of the imaging apparatus and causes poor image quality. Furthermore, there is a need for an improved process for preventing contamination of xerographic imaging apparatus, and for obtaining images that are smudge resistant, and have adequate fixing characteristics.

SUMMARY OF THE INVENTION

It is an object of the present invention to provide an improved process which overcomes the above-noted disadvantages.

Another object of the present invention resides in an improved process for preventing the contamination of components contained in a xerographic imaging apparatus.

In a further object of the present invention there is provided an improved process wherein the resulting images are smudge resistant.

In a further object of the present invention there is provided an improved process wherein there is selected as the toner composition a certain polyester resin containing therein magnetic pigments.

In yet a further object of the present invention there is provided an improved process for preventing contamination of imaging apparatuses wherein the toner particles selected are caused to adhere to the carrier particles prior to contact with the electrostatic latent image so as to substantially eliminate the migration or movement of these particles thus avoiding the unwanted deposition of such particles on machine components, thereby preventing contamination and improving the quality of the images obtained in these apparatuses. With the process of the present invention, the toner particles are not free to contaminate the machine components such as the optical system, or corona charging devices, thereby prolonging the life of these components and allowing the formation and development of images of high quality, and favorable resolution, which images are smudge resistant.

These and other objects of the present invention are accomplished by the provision of an improved process for obtaining smudge resistant images while preventing the deposition of unwanted toner particles in an imaging apparatus wherein there is selected an improved two-component contamination free developer composition. More specifically, in accordance with the present invention there is provided an improved process for obtained smudge resistant images and for preventing the deposition of unwanted toner particles in an imaging apparatus comprising (1) providing a xerographic imaging apparatus, (2) adding thereto an improved two-component contamination free developer composition comprised of a specific polyester resin component, magnetite particles, and carrier particles, (3) followed by forming and developing electrostatic latent images therein. The developer composition selected can also include as other components colorant or pigment particles, such as carbon black.

With the process of the present invention there is obtained developed images of high quality which are resistant to smudging, and further the process of the present invention simultaneously eliminates contamination of the machine components contained in the imaging apparatus as the toner particles are prevented from depositing thereon. This contrasts with many prior art processes wherein the toner particles separate from the carrier particles as a result of collisions between these particles, and the components of the imaging apparatus. Therefore, when the carrier and toner particles collide with a baffle component contained in the imaging apparatus, the toner particles will separate as a result of the force involved, that is the force of collision with the imaging components overcomes the binding force existing between the toner and carrier particles, causing the carrier particles to become detached from the toner particles. The resulting free toner particles are then caused to move within the system and after a period of time undesirably deposited on various components of the imaging apparatus causing contamination thereof. This contamination adversely effects image quality wherein in many instances images of low resolution result. Additionally, with many of the prior art development processes there are produced images that are not resistant to smudging, that is they are not adequately fixed.

Polyester resins selected for the developer composition used in the process of the present invention are comprised of the polymeric esterification product of a dicarboxylic acid and a diol comprising a diphenol of the following formula:

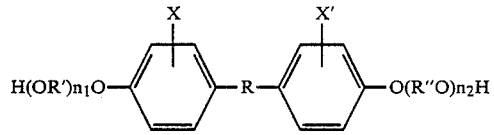

wherein R is selected from substituted and unsubstituted alkylene radicals having from about 2 to about 12 carbon atoms, alkylidene radicals having from 1 to 12 carbon atoms and cycloalkylidene radicals having from 3 to 12 carbon atoms; R' and R'' are selected from substituted and unsubstituted alkylene radicals having from 2 to 12 carbon atoms, alkylene arylene radicals having from 8 to 12 carbon atoms and arylene radicals; X and X' are selected from hydrogen or an alkyl radical having from 1 to 4 carbon atoms; and each n is a number of from 0 (zero) to 4. Diphenols wherein R represents an alkylidene radical having from 2 to 4 carbon atoms and R' and R'' represents an alkylene radical having from 3 to 4 carbon atoms are preferred as greater blocking resistance, increased definition of xerographic characters and more complete transfer of the toner images are achieved. Optimum results are obtained with diols in which R is an isopropylidene radical and R' and R'' are selected from the group consisting of propylene and butylene radicals and n is 1 (one), as the resins formed from these diols possess higher agglomeration resistance and penetrate extremely rapidly into paper receiving sheets.

Typical diphenols having the foregoing general structure include: 2,2-bis(4-beta hydroxy ethoxy phenyl)-propane, 2,2-bis(4-hydroxy isopropoxy phenyl) propane, 2,2-bis(4-beta hydroxy ethoxy phenyl) petane, 2,2-bis(4-beta hydroxy ethoxy phenyl)-butane, 2,2-bis(4-hydroxy-propoxy-phenyl)-butane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-betahydroxy ethoxy-phenyl) propane, 1,1-bis(4beta hydroxy ethoxy phenyl) cyclohexane, 2,2'-bis(4-beta hydroxy ethoxy phenyl)-norbornane, 2,2'-bis(4-beta hydroxy ethoxy phenyl)

norbornane, 2,2-bis(4-beta hydroxy styryl oxyphenyl) propane, the polyoxy-ethylene ether of isopropylidene diphenol in which both phenolic hydroxyl groups are oxyethylated and the average number of oxyethylene groups per mole is 2.6, the polyoxypropylene ether of 2-butylidene diphenol, in which both the phenolic hydroxyl groups are oxyalkylated and the average number of oxypropylene groups per mole is 2.5; and the like.

Suitable dicarboxylic acids that may be reacted with the diols described above to form the toner resins of this invention, which acids may be substituted, unsubstituted, saturated or unsaturated, include those of the general formula:

$$HOOCR'''_{n_3}COOH$$

wherein R''' is a substituted or unsubstituted alkylene radical having from 1 to 12 carbon atoms, arylene radicals or alkylene arylene radicals having from 10 to 12 carbon atoms and $n_3$ is a number of less than 2. By dicarboxylic acid it is intended to include the anhydrides of such acids where such anhydrides exist. Typical dicarboxylic acids include: oxalic acid, malonic acid, succinic acid, glutaric acid, adipic acid, pimelic acid, suberic acid, azelaic acid, sebacic acid, phthalic acid, mexaconic acid, homophthalic acid, isophthalic acid, terephthalic acid, o-phenyleneacetic-beta-propionic acid, itaconic acid maleic acid, maleic acid anhydrides, fumaric acid phthalic acid anhydride, traumatic acid, citraconic acid, and the like. Dicarboxylic acids having from 3 to 5 carbon atoms are preferred because the resulting toner resins containing same possess greater resistance to film formation on reusable imaging surfaces, and resists the formation of fines under machine operation conditions. Optimum results are obtained with alpha unsaturated dicarboxylic acids such as fumaric acid, maleic acid, or maleic acid anhydride as maximum resistance to physical degradation of the toner as well as rapid melting properties are achieved. Although it is not entirely clear, it is believed that the presence of the unsaturated bonds in the alpha unsaturated dicarboylic acid reactants provides the resin molecules with a degree of toughness, without adversely affecting the fusing and comminution characteristics.

The preferred polyester material of the present invention is the reaction product of 2,2-bis(4-hydroxy isopropoxy phenyl) propane and fumaric acid, as such a polyester when used as the toner resin in a developing composition results in images of very high resolution and superior quality.

Illustrative of magnetic materials or fillers that may be used in the present invention include, for example magnetites such as $Fe_2O_3$, $Fe_3O_4$, Mapico Black, a commercially available material, MO-4232, a magnetite commercially available from Pfizer Pigment Company, New York, N.Y., and K-378, a magnetite commercially available from Northern Pigments Corporation, Toronto, Ontario, Canada, and mixtures thereof. Mapico Black is preferred in that the particles are black in color, of low cost, and provide excellent magnetic properties.

The amount of magnetic pigment used is of importance and in one preferred embodiment is present in an amount of from about 20 to about 30 percent by weight, however, the amount of magnetic pigment present can range from about 15 percent to about 50 percent by weight. The amount of polyester material present is from about 50 percent to about 85 percent by weight, and preferably from about 70 to about 80 percent by weight. With the preferred amount of magnetic pigment, fewer toner particles separate from the carrier particles.

As other components, there may be added to the above toner composition a colorant or pigment such as carbon black including the various forms of carbon black commercially available such as Black Pearls L, Regal 330, Vulcan carbon black, mixtures thereof, and the like. The carbon black is usually persent in an amount of from about 1 percent to about 10 percent by weight, and preferably in an amount of from about 2 percent to about 5 percent by weight.

Numerous carrier materials can be employed together with the toner resin and magnetite in forming the developing composition of the present invention providing, of course, that such material is capable of triboelectrically obtaining a charge of opposite polarity to that of the toner particles. Examples of carriers selected include potassium chloride, Rochelle salt, sodium nitrate, aluminum nitrate, potassium chlorate, granular zircon, granular silicon, methyl methacrylate, glass, steel, nickel, iron ferrites, silicon dioxide and the like. The carriers can be used with or without a coating, such coatings including fluorocarbon resins such as polyvinylidene fluoride, perfluoroalkoxy fluoride resins, polymethyl methacrylate resins and the like. Many of the typical carriers that can be used are described in U.S. Pat. Nos. 2,618,441; 2,638,552; 3,618,552; 3,591,503; 3,533,835 and 3,526,533; the disclosures of each of these patents being totally incorporated herein by reference. Also, nickel berry carriers as described in U.S. Pat. Nos. 3,847,604 and 3,767,598 can be employed, these carriers being nodular carrier beads of nickel characterized by surfaces of reoccurring recesses and protrusions providing particles with a relatively large external area. The diameter of the coating carrier particles is from about 50 to about 250 microns thus allowing the carrier to present sufficient density and inertia to avoid adherence to the electrostatic images during the development process. The preferred carrier material is a carrier comprised of a steel core coated with a polyvinylidene resin or a polymethyl methacrylate resin.

The carrier may be mixed with the toner composition in any suitable combination, however, best results are obtained when there is used about 0.5 parts to about 10 parts of toner to 100 to 200 parts by weight of carrier, and preferably from about 3 parts of toner to 100 parts by weight of carrier.

The developer compositions of the present invention may be selected for the development of images in an electrophotographic apparatus, which apparatus may contain various different photoreceptors including amorphous selenium, selenium alloys, such as selenium antimony, selenium tellurium, selenium antimony tellurium, selenium tellurium, selenium antimony tellurium, selenium arsenic, and organic photoreceptors such as polyvinyl carbazole, 4-dimethyl amino benzylidene, benzhydrazide, 2-benzylidene-aminocarbazole, 4-dimethylamino-benzylidene, 2-benzylidene-aminocarbazole, polyvinylcarbazole, 2-nitrobenzylidene, para bromo aniline, 2,4-diphenyl quinazoline, 1,2,4-triazine, 1,5-diphenyl 3-methyl pyrazoline 2-(4'-dimethylamino phenyl)-benzooxazole, 3-amino carbazole, polyvinyl-carbazoletrinitrofluoronone, charge transfer complex, phthalocyanines, and layered photoreceptors, including those described in U.S. Pat. No. 4,265,990, the disclosure of which is totally incorporated herein by reference.

Numerous different known methods can be utilized for preparing the toner and developers of the present invention including spray drying, jetting, and the like, however, one preferred method for preparing the toner is hot melt formation and mastication of the toner resin, and magnetite, using a Bambury rubber mill process followed by attrition to obtain toner particle sizes, of less than 25 microns on the average, reference copending application, U.S. Ser. No. 145,171, the disclosure of which is totally incorporated herein by reference.

Surface additives may be added as optional ingredients to the developer of the present invention so as to assist in lubrication. These materials include, for example Aerosil, other silicas, metal salts of fatty acids, such as zinc stearate, mixtures thereof and the like. The Aerosil type materials function primarily as toner film reducing agent, while the stearate materials function primarily as a lubricating agent. In some instances, the toner after use and a number of imaging cycles forms a small layer of film on the photoreceptor surface which in subsequent operations will adversely effect the imaging quality, since such a layer adversely affects the electrical properties of the system. The Aerosil is present in an amount of from about 0.25 percent to about 0.65 percent while the stearate is present in an amount of from 0.10 percent to about 0.35 percent. Percentages outside these ranges may be useful providing they do not adversely affect the system and accomplish the objectives of the present invention.

When using the developer of the present invention in electrophotographic imaging systems, no contamination of the machine components occurred, or the combination was so slight so as to not adversely affect the quality of the images produced. This was demonstrated by comparing the amount of toner that was deposited on a machine component when using the toner of the present invention as compared to prior art toner compositions, as detailed herein. It was observed experimentally that significantly less toner or contamination was contained on a machine component when the developer of the present invention was employed.

The toner compositions of the present invention were found to be very useful in xerographic imaging systems or magnetic imaging systems as described hereinbefore. In these systems, the toner of the present invention together with a carrier material is employed to develop the latent electrostatic image or the magnetic latent image followed by transfer of such an image to a suitable substrate and thereafter permanently affixing the image thereto. When using the toner of the present invention in such imaging systems, images of exceptional quality were produced over substantial periods of time with very little or any unwanted toner deposition occurring on the machine parts as described in more detail hereinafter.

The invention will now be described in detail with respect to specific preferred embodiments thereof, it being understood that these examples are intended to be illustrative only and the invention is not intended to be limited to the materials, conditions, process parameters, and the like recited herein. All parts and percentages are by weight unless otherwise indicated.

EXAMPLE I

There was prepared by melt mixing followed by mechanical attrition a toner resin by mixing together 50 percent by weight of the polyester resin which is the reaction product of 2,2-bis(4-hydroxy isopropoxy phenol) propane and fumaric acid, which polyester is commercially available from ICI Corporation, 50 percent by weight of the magnetic iron oxide commercially available as Mapico Black, and as surface additives (not part of the resin blend) 0.65 percent by weight of Aerosil, and 0.35 percent by weight of zinc stearate.

Three parts by weight of the above toner resin together with 100 parts by weight of carrier material comprised of steel coated with a polymethyl methacrylate resin were admixed together resulting in a dual component developing composition, which when used in a xerographic imaging system with magnetic brush development produced high quality copies of exceptional resolution. Inspection of the machine components reveals substantially no deposition of toner, or other contamination.

EXAMPLE II

The procedure of Example I was repeated with the exception that there was selected as the toner composition 75 percent by weight of the polyester resin, 20 percent by weight of the magnetite Mapico Blac, and 5 percent by weight of carbon black, Black Pearls L, and substantially similar results were observed.

EXAMPLE III

The procedure of Example I was repeated with the exception that there was used in place of Black Pearls L, 5 percent by weight of the carbon black Regal 330 and substantially similar results were obtained.

EXAMPLE IV

The procedure of Example I was repeated with the exception that there was used 70 percent by weight of the polyester resin, 20 percent by weight of Mapico Black, 5 percent by weight of Black Pearls L and 5 percent by weight of Nigrosine, and substantially similar results were obtained.

EXAMPLE V

The procedure of Example I was repeated with the exception that there was used 75 percent by weight of the polyester resin, and 25 percent by weight of Mapico Black with no carbon black being present. When this developer composition, three parts by weight, was mixed with 100 parts by weight of the carrier of Example I there was obtained exceptional prints of high quality after 7,500 imaging cycles. Additionally, it was observed that substantially no contamination occurred on the machine components as compared to substantial contamination when a developer composition comprised of 90 percent by weight of the same polyester resin, 10 percent by weight of Black Pearls L, carbon black, and the carrier of Example I were selected.

EXAMPLE VI

The procedure of Exmple I was repeated with the exception that there was prepared a toner and developer composition containing 72 percent by weight of the same polyester resin, 20 percent by weight of Mapico Black, 6 percent by weight of the carbon black Regal 330, and 2 percent by weight of the charge control additive cetyl pyridinium chloride. Substantially similar results were obtained when this developer composition was used in the xerographic imaging system of Example I.

There was then used as a developer in the process of the present invention, for developing images in a xerographic imaging apparatus with magnetic brush development, commercially available from Xerox Corporation as the 3300 machine, a toner which consisted of 75 percent by weight of the polyester resin of Example I, (reaction product of 2,2-bis(4-hydroxy isopropoxy phenyl) propane and fumaric acid), and 25 percent of Mapico Black, a commercially available magnetic iron oxide. Toner particles or dirt was not observed on the corotron, after 2,500 imaging cycles; as compared to the observation of substantial amounts of "dirt" or toner particles, after 2,500 imaging cycles, where the same developer was selected without Mapico Black for use in the 3300 machine. About 25 percent of the corotron contained unwanted toner particles when no Mapico Black was used in the developer composition.

Images of very low quality, which images contained substantial areas of unwanted background deposits were obtained in the 3300 machine after 2,500 copies in view of the deposition of the toner particles on the corotron, while images of high quality with no background deposits were obtained in the 3300 machine after 2,500 copies with the developer containing Mapico Black.

Substantially similar results were observed when the above toner compositions were used in a 3300 machine in that a baffle on the development housing contained substantial amounts of unwanted toner particles, about 75 percent of the baffle being covered, when no Mapico Black was present, as compared to no "dirt" or toner particles on the same baffle in the 3300 machine when Mapico Black was present in the toner.

Further experiments indicated the deposition of 60 particles per square millimeter per second on a filter device with the above developer composition containing no Mapico Black, as compared to the deposition of 6 particles per square millimeter per second on the same filter device with the above developer composition, containing Mapico Black.

It is believed that the toner particles adhere to the carrier particles in the developer compositions of the present invention primarily because of the magnetic field that is created by the magnetic brush development system, present in many xerographic imaging system.

EXAMPLE VII

There was prepared by repeating the procedure of Example I, a toner composition with one of the resins as disclosed in U.S. Pat. No. 3,239,466. More specifically, there was prepared by melt blending followed by mechanical attrition, a toner composition containing 74 percent by weight of a polyester resin, commercially available as 666U from Dow Chemical Corporation, 20 percent by weight of Mapico Black, a magnetite commercially available, and 6 percent by weight of carbon black. Subsequently, a developer composition was prepared by preblending the above toner composition, 1.5 percent toner concentration, (1.5 parts of toner per 100 parts by weight of carrier) with carrier particles containing a steel core, coated with 0.4 percent by weight of a polymethacrylate resin, the carrier particles having a diameter of 100 microns.

This developer composition was then selected for developing images in a xerographic imaging apparatus with magnetic brush development, which apparatus is commercially available from Xerox Corporation as the 2600 imaging machine. During development, the process speed of the machine was established at 2 inches per second, and the copy rate was 12 copies per minute. The fusing unit contained in this apparatus is a radiant type device with an additional base unit, the input power to the radiant quartz lamp contained in the machine being 850 watts. The base type was set at a temperature of 225 degrees centigrade. Also, the temperature was maintained at 250 degrees, and the radiant lamp was caused to flash when copies pass through the fusing station contained in the machine.

After about 1,000 copy cycles, and subsequent to fusing, the resulted images did not fix properly, could be easily erased, and were not smudge resistant.

In contrast with a process containing the developer composition of the present invention there resulted images that were smear resistant. There was thus prepared a toner composition containing 74 percent by weight of the polyester prepared from 2,2'-bis(4-hydroxy isopropoxy phenyl) propane and fumaric acid, 20 percent by weight of Mapico Black, commercially available, and six percent by weight of carbon black, by melt blending these ingredients followed by mechanical attrition.

Subsequently, developer composition was prepared by preblending the above toner composition, 1.5 percent toner concentration, (1.5 parts by weight of toner per 100 parts by weight of carrier), with the carrier containing a steel core, and 0.4 percent by weight of a coating of polymethylmethacrylate polymer. The carrier particles were of a diameter of 100 microns. This developer composition was then incorporated into the same 2600 machine described above and after 1,000 copies, and subsequent to fusing, there resulted images which could not be easily erased, and were smudge resistant. These images were essentially smudge proof as evidenced by a visual observation.

The disclosure of the parent application U.S. Ser. No. 219,674 is totally incorporated herein by reference.

Other modifications of the present invention will occur to those skilled in the art upon a reading of the present disclosure. These are intended to be included within the scope of this invention.

We claim:

1. A process for obtaining smudge resistant images and for preventing the deposition of unwanted toner particles in an imaging apparatus consisting essentially of (a) providing a xerographic imaging apparatus, (b) adding an improved two component contamination free developer composition to said apparatus, which composition consists essentially of from about 50 percent to about 80 percent by weight of a resin comprised of the polymeric esterification product of a dicarboxylic acid and a diol comprising a diphenol of the following formula

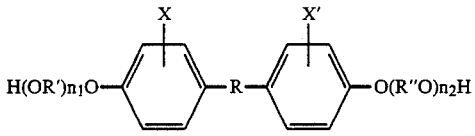

wherein R is selected from substituted and unsubstituted alkylene radicals having from about 2 to about 12 carbon atoms, alkylidene radicals having from 1 to 12 carbon atoms and cycloalkylidene radicals having from 3 to 12 carbon atoms; R' and R" are selected from substituted and unsubstituted alkylene radicals having from 2 to 12 carbon atoms, alkylene arylene radicals having from 8 to 12 carbon atoms and arylene radicals; X and X'; are selected from hydrogen or any alkyl radical having from 1 to 4 carbon atoms; and each n is a number of from 0 (zero) to 4, about 20 percent to about 50 percent by weight of magnetite and a carrier material consisting of a steel core coated with a polymethyl methacrylate resin or a polyvinylidene fluoride resin, (c) forming electrostatic latent images in the imaging apparatus, and (d) developing the images formed.

2. A process in accordance with claim 1 wherein the polyester is the reaction product of 2,2-bis(4-hydroxy isopropoxy phenyl) propane and fumaric acid, said resin being present in the amount of from about 70 percent to about 80 percent by weight, and wherein the magnetite is present in the amount of from about 20 percent to about 30 percent by weight.

3. A process in accordance with claim 1 wherein the polyester resin is present in an amount of from about 68 percent by weight to 72 percent by weight, the magnetite is present in an amount of from about 20 percent by weight to about 27 percent by weight, and there is included therein carbon black present in an amount of from about 0.5 percent to about 6 percent by weight, and further including therein as optional components 0.5 percent by weight of a silica material, and 0.28 percent by weight of zinc stearate.

4. A process in accordance with claim 1 wherein there is present 74 percent by weight of the polyester resin prepared from 2,2'-bis(hydroxy isopropoxy phenyl) propane and fumaric acid, 20 percent by weight of magnetite, 6 percent by weight of carbon black, and wherein the carrier particles consist of a steel core coated with a polymethylmethacrylate polymer.

5. A process in accordance with claim 4, wherein the carrier coating is present in an amount of 0.4 percent by weight.

6. A process in accordance with claim 4, wherein the developer is prepared by preblending about 1.5 parts by weight of the toner composition with 100 parts by weight of the carrier particles.

7. A process in accordance with claim 4, wherein the carrier particles selected have a diameter of about 100 microns.

* * * * *